United States Patent [19]

Henson

[11] Patent Number: 4,461,469

[45] Date of Patent: Jul. 24, 1984

[54] BALL COURT WITH MULTIPLE REBOUND SURFACES

[76] Inventor: William Henson, 1235 McKeel St., Yorktown Heights, N.Y. 10598

[21] Appl. No.: 349,623

[22] Filed: Feb. 17, 1982

[51] Int. Cl.[3] ..... A63B 63/00

[52] U.S. Cl. ..... 272/3; 273/411

[58] Field of Search ..... 272/3; 273/31, 76, 342, 273/411, 410

[56] References Cited

U.S. PATENT DOCUMENTS

| | | | |
|---|---|---|---|
| 2,229,180 | 1/1941 | Larson | 273/411 X |
| 2,629,594 | 2/1953 | Forsyth | 273/30 |
| 3,758,106 | 9/1973 | Liebig | 273/411 X |
| 4,239,214 | 12/1980 | Brenner | 273/342 X |

OTHER PUBLICATIONS

*Washington Post,* Racquetball Comes to the Washington Area with a Bang", 6/1978.

*Primary Examiner*—Richard T. Stouffer

*Assistant Examiner*—William H. Honaker

*Attorney, Agent, or Firm*—Ostrolenk, Faber, Gerb & Soffen

[57] ABSTRACT

The disclosure concerns a court for a ballgame. A vertical wall is upstanding from a horizontal player surface. An inclined wall extends forwardly of the vertical wall. At each side end of the inclined wall, two inclined generally triangularly shaped panels are provided, each turned more toward the opposite wall. Over the top of the court is an optional ceiling. At the sides of the court, are optional side walls. At the rear of the court may be an optional rear wall.

29 Claims, 5 Drawing Figures

BALL COURT WITH MULTIPLE REBOUND SURFACES

BACKGROUND OF THE INVENTION

The present invention relates to a court for playing ball, and particularly to such a court having multiple rebound surfaces.

A conventional court has a rebound surface comprising a flat vertical front wall. Enclosed courts may also have a ceiling and side walls.

Ball courts are known with various unusual configurations for their front walls. For example, in U.S. Pat. No. 2,229,180, the front wall is a vertical wall that is topped by a wall that is inclined forwardly of the playing floor to define a court. This court lacks any side panels and a ball hit to the side of the court will not rebound back on the court.

U.S. Pat. Nos. 2,161,463; 2,066,724; 2,629,594; 3,758,106; and 3,133,734 each show a court with a number of panels at the front. Each panel meets adjacent panels at angles less than 180°. The angles at which and the axes about which the panels meet are selected to generally rebound the ball back onto the playing floor.

SUMMARY OF THE INVENTION

The front wall of the court according to the invention causes a ball to rebound generally upward, rearward from the front wall and inward toward the opposite side of the court. The various rebound surfaces of the court do not all meet at angles defined around either a single axis or parallel axes, either horizontal or vertical and, the rebound surfaces are inclined partially upward.

The court according to the invention has a horizontal playing floor or surface on which the players move. The front of the court is defined by a vertical, upstanding wall. Above that vertical wall is a forwardly inclined wall which defines the front wall of the playing court. A ball hit against the inclined wall will usually rebound upwardly and to the rear. Of course, depending upon the manner in which the ball has been hit by a player, the path of the ball as it strikes the inclined wall and other factors, the ball may rebound in any direction and may even roll off the inclined wall and fall flat.

At each side end of the inclined wall, there is at least one panel which is turned around a vertical axis with respect to both the vertical wall and the inclined wall and the one panel is in a plane that intersects the planes of both the vertical and inclined walls. In the preferred embodiment, at each side end of the inclined wall, there are two such panels, with the first of the panels being turned at a first angle with respect to the adjacent inclined wall and with the second panel meeting the first panel and being turned at a greater angle with respect to the inclined wall. In particular, the second panel is preferably in a sloping plane such that the top and bottom edge of the second panel are perpendicular to the top and bottom edge of the inclined wall. The first and second panels are also inclined outwardly as they incline upwardly, for usually causing a ball that strikes either panel to rebound upwardly. Of course, as with the inclined wall, various factors control each rebound. The angles of incline of the inclined wall and of the panels and the angles at which the panels meet each other and meet the inclined wall are all selected for optimum rebound characteristics.

The panel or panels at each end of the inclined wall are widest at the top of the inclined wall and taper narrower toward the bottom of the inclined wall. In a preferred embodiment, the first and second panels terminate before they meet the bottom of the inclined wall, whereby these panels have the shape of truncated triangles or quadrilaterals. Where the top and bottom edges of the panel are parallel, the panels are trapezoidal in shape. With the truncated triangular panels, a notch or pocket is formed in the space under these panels at the bottom of the inclined wall. Additional panel surfaces are provided to extend from the bottom of the truncated triangular panels forwardly to the inclined wall and then downward to the bottom of the inclined wall. These inclined panels may be oriented precisely horizontally and vertically, although other orientations are possible. Furthermore, these panels may be inclined for directing a ball that strikes them downwardly, or toward the other side of the court, depending upon precisely how the additional panels are inclined.

In another embodiment, the panels are not truncated, but extend all the way down to their apex which is located at the bottom of the inclined wall. In the latter case, the panels are all generally triangular in shape.

Although the court needs no ceiling over the top, and without a ceiling a rebounding ball may loft quite high, a ceiling may be provided over the top of the court. The court of the invention may be positioned or constructed inside an existing ball court, which may have a ceiling in place. From the inclined wall the ceiling extends rearwardly over the horizontal surface.

No additional side walls besides the above noted panels are required. However, there may be side walls which extend from the panels and the vertical wall, rearwardly past the opposite sides of the horizontal surface and these side walls may extend up to a ceiling, if there is one.

Other objects and features of the present invention will become apparent from the following description of preferred embodiments of a court considered in conjunction with the accompanying drawings.

DESCRIPTION OF THE PREFERRED EMBODIMENTS

Figure 1:
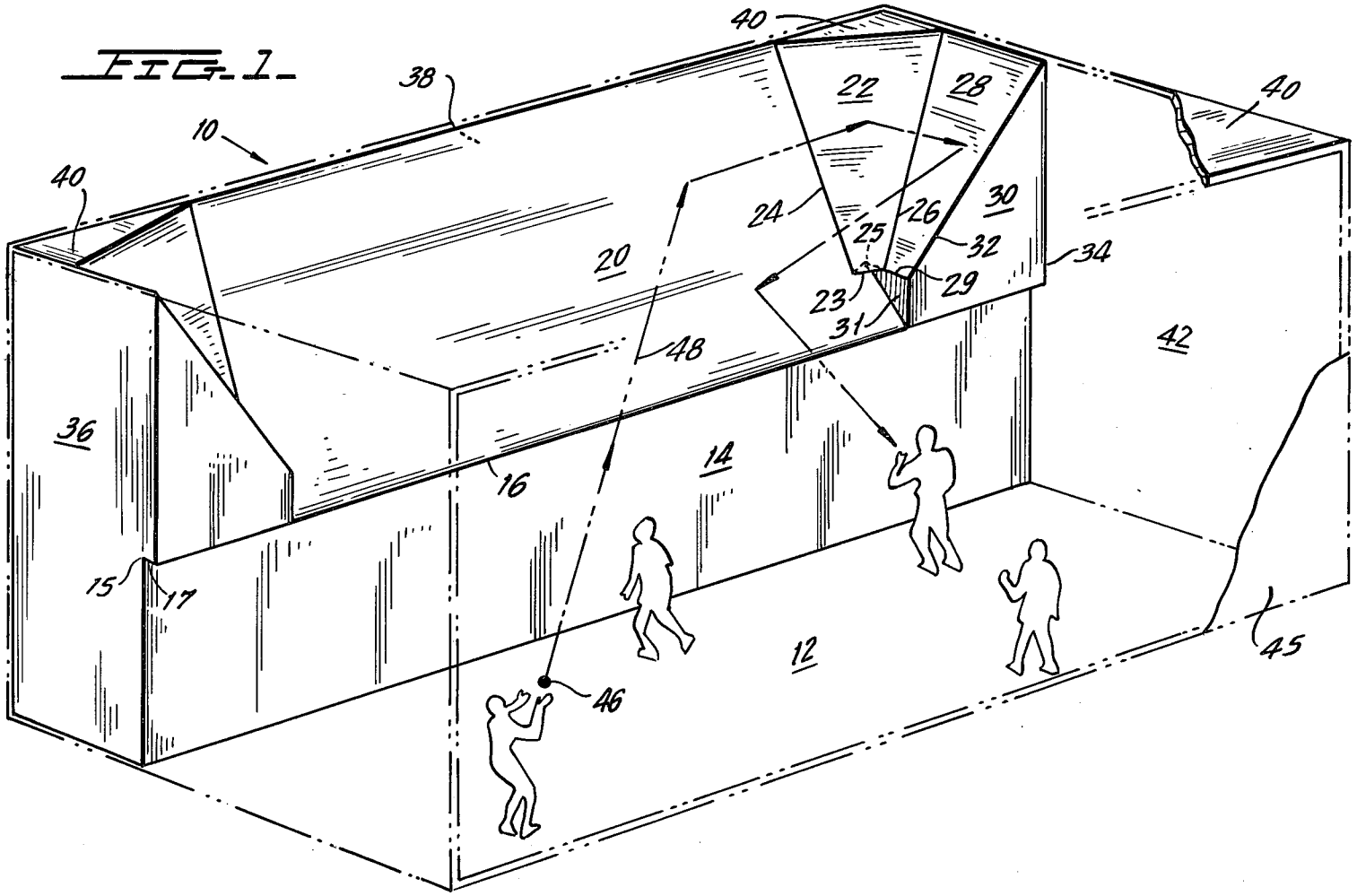
FIG. 1 is a perspective view of a preferred embodiment of a ball court according to the invention.
Figure 2:
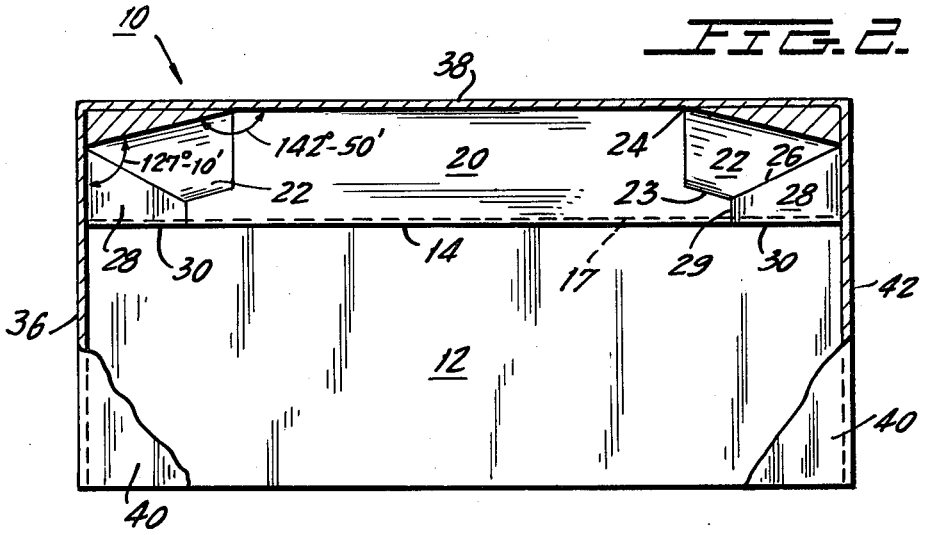
FIG. 2 is a plan view from above of the court, taken along the line 2—2 in FIG. 3.
Figure 3:
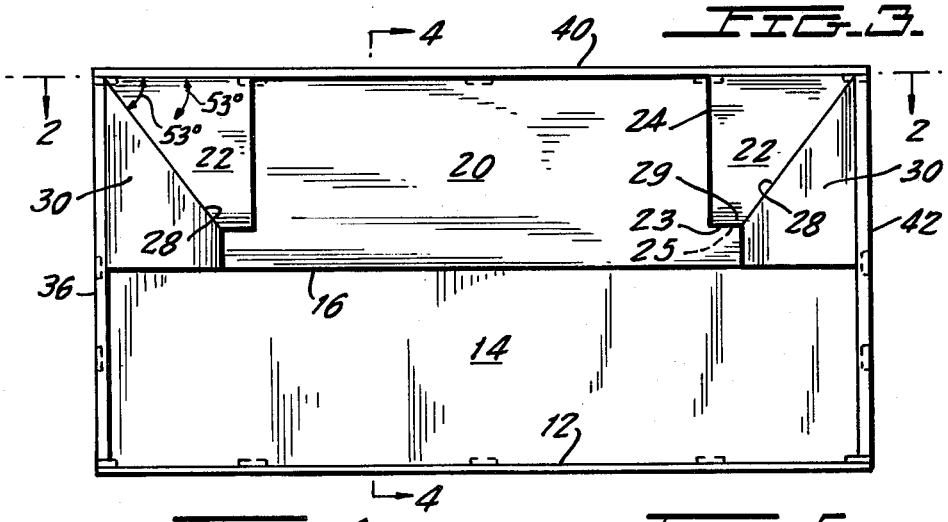
FIG. 3 is an elevational view looking toward the front of the court.
Figure 4:
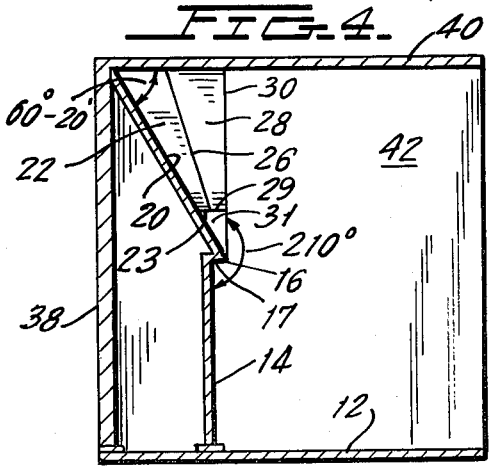
FIG. 4 is a cross-sectional view of the court along the line 4—4 in FIG. 3.

The first embodiment of the court 10 shown in FIGS. 1–4 includes a rectangular horizontal playing floor or surface 12 on which the players stand. There is an upstanding, rectangular vertical wall 14 at the front of the court which extends perpendicularly up from the horizontal surface. The top edge 15 of the front wall 14 is defined taller than the height of a player, and a typical wall 14 would be about 10 feet in height. Above the vertical wall 14 there is a short, rearwardly jutting lip 17. A forwardly inclined, rectangular, flat wall 20 extends up from its bottom 16 which is located at the lip 17, and up from the vertical wall 14. Viewed from the playing surface 12, the wall 20 is inclined at an angle that might be about 210°. The inclined wall 20 extends up a vertical height of about an additional 10 feet, for example.

The lateral side sections of the court are mirror images of each other and are symmetrical. One of these is now described, the other being identical. To the side of the inclined wall 20, there is an upstanding, inclined panel 22, which is generally triangularly shaped, is truncated to define a quadrilateral, and particularly a trapezoid, and narrows toward its bottom end 23 near the bottom 16 of the inclined wall 20. The inclined panel 22 is inclined forwardly of the court, and outwardly with respect to the walls 14 and 20. The panel 22 is also turned obliquely so that it generally faces toward the opposite side of the court, whereby the panel 22 is in a plane which intersects the planes of both the inclined wall 20 and the vertical wall 14. In the preferred illustrated embodiment, the top edge of the panel 22 meets the top edge of the inclined wall 20 along a respective meeting of the top of edge 24 at an angle of approximately 143°. As the panel 22 is spaced a distance away from the inclined wall 20 at the bottom end 23 of the panel, the open space between the panel 22 and the inclined wall 20 at the bottom end 23 of the panel, the open space between the panel 22 and the inclined wall 20 is closed off at the top by the downwardly facing triangular panel 25 which extends flat horizontally. This defines a notch or pocket under the panel 22.

The other outer edge 26 of the panel 22 meets another upstanding, inclined panel 28, which is also generally triangularly shaped, truncated to define a quadrilateral, and particularly a trapezoid, and narrows towards its bottom end 29 near the bottom 16 of the inclined wall 20. The panel 28 is also inclined outwardly with respect to the side of the court. The top edge of panel 28 meets the middle panel 22 at the top of edge 26 at an angle of approximately 127. The space between the bottom 29 of the panel 28 and the bottom of the inclined wall is closed off by the vertically oriented, triangularly shaped panel 31 which has its top side extending along the bottom of the panel 28 to contact the inclined wall 20, down along the inclined wall 20 to the bottom thereof at the apex of the panel 31 and up from the bottom of the inclined wall to the exterior corner of the bottom of the panel 28. Therefore, the panel 31 defines one edge of the panel 25, the wall 20 defines a second edge of the panel 25 and the bottom 23 of the panel 22 defines the third side of the triangular panel 25. The panels 25 and 31 and the wall 20 define the notch or pocket under panels 22 and 28.

The permissible play area of the court is contemplated to be the area above the bottom 16 of the inclined wall and including the inclined wall 20, the panels 22 and 28 and the closure panels 25 and 31.

For a complete court structure, there is a panel 30 which extends from the outward edge 32 of the panel 28 out to the outer side edge 34 of the court. It is contemplated that the panel 30 will be out-of-bounds for play. The area behind the walls 14 and 20 may have a side wall 36 but this is an area that is in front of the court and is not in-bounds for play.

Especially when the court is situated indoors, but not limited to this, there may be a ceiling 40 over the top of the court extending rearwardly from the top edge 38 of the inclined wall 20. The ceiling 40 extends parallel to the horizontal playing surface. The ceiling meets the inclined wall 20 at an angle of about 60. Both the panel 22 and the panel 28 intersect the ceiling 40 at angles of approximately 53 to 60. It is contemplated that the ceiling 40 would be in-bounds in play, so that a ball striking the inclined wall 20 or the panels 22 or 28 could bounce off the underside of the ceiling 40 and still be in play.

The court may also be provided with side walls 42 which extend rearwardly along the side of the horizontal playing surface. The walls 42 could be in-bounds in play for any ball bouncing off one of the panels 20, 22, 25, 28 or 31.

Optionally, a rear wall 45 parallel to the vertical front wall 14 may be provided at the rear end of the playing surface 12. The rear wall could also be in-bounds or out-of-bounds for a ball in play.

One possible trajectory 48 for a playing ball 46 is illustrated in broken lines in FIG. 1, and it shows the interesting pathway which a ball might follow in striking the various panels. The angling of the panels 22 and 28 directs the ball generally back toward the opposite side of the court, and the panels 22 and 28 and the wall 20 are all inclined upwardly so as to rebound the ball upwardly in the court.

Figure 5:
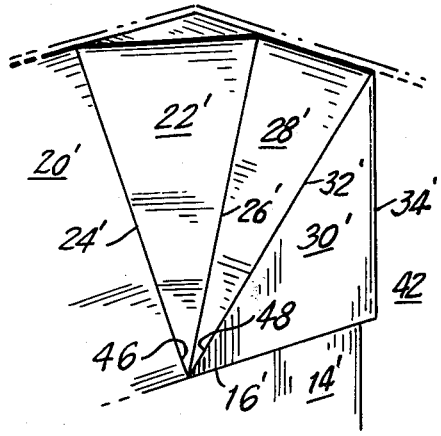
FIG. 5 is a perspective view of a fragment of a second embodiment of a ball court according to the invention.

The second embodiment of the invention is shown in FIG. 5. It differs only in the area toward the bottoms of the inclined panels and thus only that fragment of one side of the court is shown in FIG. 5 to illustrate the second embodiment. Elements in the second embodiment of FIG. 5 that correspond to elements of the first embodiment are correspondly numbered with primed reference numerals.

Instead of being truncated at their bottom end, the panels 22' and 28' are completely triangularly shaped and have respective apices 46 and 48 at which these triangular panels meet the bottom end 16' of the inclined wall 20'. The notches in the first embodiment which are defined by the small triangular panels 25 and 31 and the cooperating inclined wall 20 are not present in the second embodiment.

The rules of play of a ballgame played on the court are not part of the present invention. However, in one variation game, it is contemplated that the players will hit the ball off only the inclined wall 20; and the panels, 22, 25, 28 and 31, and if the ball strikes the vertical wall 14 or the side walls 42 or rear wall, if any, the ball will be out of bounds. Furthermore, once a player serves the ball into play, the players must keep the ball from falling to the horizontal surface 12. The upwardly inclined wall 20 and panels 22 and 28 would cooperate for this purpose. Other games or ways of playing on the court as described herein may be devised by one skilled in the art. The inclined wall and panels, coupled with the generally triangular shapes of the panels, narrowing toward the bottom 16 of the inclined wall 20 produces a novel court construction and facilitates the playing of a novel and interesting ball court game.

Although the present invention has been described in connection with the preferred embodiment thereof, many other variations and modifications will now become apparent to those skilled in the art. It is preferred, therefore, that the present invention not be limited by the specific disclosure herein.

I claim:

1. A court for a ballgame, comprising;

a horizontal surface for players to stand upon;

a vertical wall upstanding from the horizontal surface at the front of the court;

an upstanding, inclined wall extending above the vertical wall and being inclined forward away from the horizontal surface on which the players stand; the inclined wall having opposite left and right side ends;

at each of the left and right ends of the inclined wall and also above the vertical wall, at least one upstanding flat panel having a rebound surface being provided; each panel being turned at an angle out of the plane of the vertical wall so that its rebound surface generally faces toward the opposite panel rebound surface and respective side of the court, each panel being turned at an angle so that a ball striking that panel will rebound both generally toward the opposite side of the court and rearwardly away from the vertical wall and each panel tapering in its width dimension toward the bottom of the inclined wall.

2. The court of claim 1, wherein the inclined wall is inclined to the vertical wall at an angle of about 210°.

3. The court of claim 1, wherein each panel is truncated with a bottom end above the bottom of the inclined wall, thereby, defining a notch in the space between the bottom end of the panel and the bottom of the inclined wall.

4. The court of claim 1, wherein each panel narrows to an apex at the bottom of the inclined wall.

5. The court of claim 4, wherein each panel is generally triangular in shape.

6. The court of claim 1, wherein the top edge of each panel meets the inclined wall at an angle of about 143°.

7. The court of claim 1 wherein each panel is also inclined forwardly of the court, and outwardly with respect to the vertical.

8. The court of claim 1, further comprising a ceiling located above and meeting the top of the inclined wall and the tops of the panels and the ceiling extending rearwardly from the inclined wall over the horizontal surface.

9. The court of claim 8, wherein the ceiling meets the inclined wall at an angle of about 60°.

10. The court of claim 8, wherein each panel ls also inclined forwardly of the court, and outwardly and upwardly with respect to the vertical.

11. The court of claim 1, wherein each panel has a first edge at which the panel meets the inclined wall and has a second edge at the side of the panel away from the first edge thereof;

a second upstanding panel having a rebound surface and located at each end of the inclined wall; each of the second panels being attached at the second edge of the respective first mentioned panel; each second panel being turned out of the plane of the vertical wall so that its rebound surface generally faces toward the other second panel surface and each second panel being turned in that direction of turn thereby further than the respective first panel is turned.

12. The court of claim 11, wherein each second panel tapers in its width dimension toward the bottom of the inclined wall.

13. The court of claim 12, wherein each second panel also narrows to a respective apex at the bottom of the inclined wall.

14. The court of claim 13, wherein each first panel also tapers in its width dimension toward the bottom of the inclined wall.

15. The court of claim 14, wherein each panel is generally triangular in shape.

16. The court of claim 12, wherein each first panel also tapers in its width dimension toward the bottom of the inclined wall.

17. The court of claim 16, wherein each of the first and second panels is truncated with a bottom end spaced above the bottom of the inclined wall, thereby defining a notch in the space between the bottom end of the first and second panels at one end of the inclined wall and the bottom of the inclined wall.

18. The court of either of claims 3 or 17, wherein between the bottom ends of the panels and the inclined wall an open space is defined; additional panels extend across that open space at the ends of the inclined wall.

19. The court of claim 11, wherein the top edge of each second panel meets the top edge of the respective first panel at an angle of about 127°.

20. The court of claim 19, wherein the top edge each first panel meets the top edge of the inclined wall at an angle of about 143°.

21. The court of claim 11, wherein each upstanding panel is also inclined outwardly with respect to the vertical.

22. The court of claim 21, wherein the first panel is also inclined forwardly of the court.

23. The court of claim 11, further comprising a ceiling located above and meeting the top of the inclined wall and the tops of the panels and the ceiling extending rearwardly from the inclined wall over the horizontal surface.

24. The court of claim 23, wherein each upstanding panel is also inclined outwardly with respect to the vertical.

25. The court of claim 23, wherein the ceiling meets the inclined wall at an angle of about 60°.

26. The court of claim 11, further comprising side walls extending away from the second panels and extending rearwardly from the vertical wall and the side walls being opposite each other across the horizontal surface.

27. The court of claim 11, wherein the first panel is also inclined forwardly of the court and outwardly with respect to the vertical.

28. The court of claim 1, wherein each panel is inclined outwardly with respect to the vertical.

29. A court for a ballgame, comprising;

a horizontal surface for players to stand upon;

a vertical wall upstanding from the horizontal surface at the front of the court;

an upstanding, inclined wall extending above the vertical wall and being inclined forward away from the horizontal surface on which the players stand; the inclined wall having opposite left and right side ends;

at each of the left and right ends of the inclined wall and also above the vertical wall, at least one upstanding flat panel having a rebound surface being provided; each panel being turned at an angle out of the plane of the vertical wall so that its rebound surface generally faces toward the opposite panel rebound surface and respective side of the court, each panel being turned at an angle, inclined forwardly of the court, and outwardly with respect to the vertical so that a ball striking that panel will rebound both generally toward the opposite side of the court and rearwardly away from the vertical wall.

* * * * *